United States Patent [19]

Gerlach

[11] Patent Number: 4,806,754

[45] Date of Patent: Feb. 21, 1989

[54] HIGH LUMINOSITY SPHERICAL ANALYZER FOR CHARGED PARTICLES

[75] Inventor: Robert L. Gerlach, Minnetonka, Minn.

[73] Assignee: The Perkin-Elmer Corporation, Norwalk, Conn.

[21] Appl. No.: 64,283

[22] Filed: Jun. 19, 1987

[51] Int. Cl.[4] ..... H01J 40/00; H01J 47/00

[52] U.S. Cl. ..... 250/305; 250/309

[58] Field of Search ..... 250/306, 307, 296, 305

[56] References Cited

U.S. PATENT DOCUMENTS

| | | | |
|---|---|---|---|
| 3,617,741 | 11/1971 | Siegbahn et al. | 250/49 |
| 3,742,214 | 6/1973 | Helmer et al. | 250/305 |
| 3,766,381 | 10/1973 | Watson | 250/305 |
| 3,949,221 | 4/1976 | Liebl | 250/281 |
| 4,048,498 | 9/1977 | Gerlach et al. | 250/305 |
| 4,126,781 | 11/1978 | Siegel | 250/305 |
| 4,296,323 | 10/1981 | Gerbach | 250/309 |
| 4,593,196 | 6/1986 | Yates | 250/305 |

OTHER PUBLICATIONS

Ritchie, Cheka and Birkhoff, "The Spherical Condenser as a High Transmission Particle Spectrometer", *Nuclear Instruments and Methods,* vol. 6, pp. 157–163 (1960).

Weichert and Helmer, "IEE—A New Type of X-ray Photoelectron Spectrometer", Varian Assoc., Palo Alto, Calif.

Englehardt, Back and Menzel, "Novel Charged Particle Analyzer for Momentum Determination in the Multi-Channeling Mode", *Review of Scientific Instruments,* vol. 52, pp. 835–839, (1981).

*Primary Examiner*—Bruce C. Anderson

*Attorney, Agent, or Firm*—H. S. Ingham; F. L. Masselle; E. T. Grimes

[57] ABSTRACT

An energy analyzer for electrons comprises three spherically configured cylindrically symmetric members. An outer member is a hollow spherical section having a first inlet edge. A first inner member is a spherical portion disposed concentrically within the outer member with a defined space therebetween, and has a second inlet edge cooperative with the first inlet edge to form an inlet opening receptive of electrons from a conical lens. A second inner member is a spherical segment disposed concentrically within the outer member and has a second outlet edge cooperative with a first outlet edge of the first inner member to define an exit slot for egress of charged particles having selected trajectories in the defined space. A cylindrical detector is situated within the spherical members for detecting the egressed charged particles. The inlet opening and the exit slot are such that the angle subtended by the selected trajectories between the inlet opening and the exit slot is preferably between about $0.8\pi$ and $\pi$ radians.

11 Claims, 1 Drawing Sheet

HIGH LUMINOSITY SPHERICAL ANALYZER FOR CHARGED PARTICLES

The present invention relates generally to energy analysis of charged particles and particularly to a spherical analyzer useful for x-ray photoelectrons and Auger electrons.

BACKGROUND OF THE INVENTION

A variety of electron microscopes and associated surface analyzers have evolved in recent years. A popular type is a scanning electron microscope in which a focused electron beam is scanned over a sample surface where secondary electrons are emitted and detected in correlation with scanning position. The secondary electrons are processed electronically to provide a picture of topographical features. Associated mapping of chemical constituents in the surface is achieved with characteristic x-rays produced by the electron beam.

Another method of measuring for constituents near the surface of a sample is electron spectroscopy for chemical analysis (ESCA) which involves irradiating a sample surface with x-rays and detecting the characteristic photoelectrons emitted. The photoelectrons are filtered by electrostatic or magnetic means to pass through electrons of a specified energy. The intensity of the filtered beam reflects the concentration of a given chemical constituent of the sample surface.

U.S. Pat. No. 3,617,741 (Siegbahn et al.) for example, teaches the use of a hemispherical electrostatic analyzer (SCA) for selectively filtering electron energy for ESCA. An outer hemisphere is maintained at a negative potential with respect to an inner concentric hemisphere so as to cause electrons entering the space between the hemispheres to follow curved trajectories according to electron energy. The 180° ($\pi$ radians) trajectory defined by the hemispheres is especially desirable because the electrons exit the hemispheres in an image plane that correlates with the inlet image, providing for optimum energy resolution. The patent also discloses an input lens system for modifying the energy of the electrons entering the SCA.

Hemispherical analyzers are used similarly for analysis and spectroscopy with secondary Auger electrons generated at the sample surface by the focused primary electron beam. Auger microprobes are suitable for detecting elements with low atomic numbers and have sensitivity to a few atomic layers. Surface mapping of elements is accomplished by scanning with the primary electron beam.

Another electron optical system useful for filtering and spectroscopy utilizes a cylindrical mirror analyzer such as described in U.S. Pat. No. 4,048,498 (Gerlach et al.). In such an arrangement, concentric cylinders, with the outer being charged negatively with respect to the inner, refract diverging electron beams back to the axis of the cylinders and filter in a manner similar to the hemispherical analyzer. However, the cylindrical filter does not provide a very narrow band of energies, i.e. energy resolution.

A problem with the aforementioned hemispherical type of analyzer is that solid collection angle efficiency is relatively low and, also, the hemispherical analyzer is not efficiently used. In particular, charged particles traverse the spherical analyzer only in a small region, proximate a single plane intersecting the spherical center. An effort to expand the input solid angle of a spherical analyzer is described in "The Spherical Condenser as a High Transmission Particle Spectrometer" by R. H. Ritchie, J. S. Cheka and R. D. Birkhoff, *Nuclear Instruments and Methods,* Vol. 6, pages 157–163 (1960). A source of charged particles is placed on the inner sphere and charged particles follow trajectories in all directions through the volume between spheres. The particles exit in a conically converging pattern for detection. This system does not allow for any preliminary optics or filtering of the charged particles prior to energy analysis.

Efficient use of input solid angle is also described in "IEE—A New Type of X-ray Photoelectron Spectrometer" by N. H. Weichert and J. C. Helmer, Varian Associates, Palo Alto, Calif. Two concentric spherical electrodes in figure of rotation are described, the spheres being sectioned to receive particles from a sample on the axis of rotation. The particles pass through the analyzer and focus back to the axis where they are detected. This system is more versatile than that described by Ritchie et al.; however, the arrangement does not allow for the advantages of a 180° path in the spherical analyzer. Such a 180° path allows for electrons to originate a large distance off axis, thereby giving large luminosity (input area times solid angle) which is especially important for ESCA.

A similar device is described in "Novel Charged Particle Analyzer for Momentum Determination in the Multi-Channeling Mode" by H. A. Engelhardt, W. Back and D. Menzel, *Review of Scientific Instruments.* Vol. 52, pages 835–839 (1981). Trajectory angle is increased by bringing particles back to the detector at the axis perpendicularly. In this device, a truncated conical lens coaxial with the analyzer is utilized for retarding and focusing electrons into the analyzer from a sample surface at the axis.

In view of the foregoing, a primary objective of the present invention is to provide an energy analyzing system for charged particles with improved collection efficiency and energy resolution.

Another object is to provide a novel spherical capacitor energy analyzer for charged particles.

A further object is to provide a novel energy analyzer with both high luminosity and high input solid angle that is particularly useful for x-ray photoelectron chemical analysis of large or small surface areas.

Yet another object is to provide a novel energy analyzer with high input solid angle, that is particularly useful for Auger electrons.

BRIEF DESCRIPTION OF THE INVENTION

The foregoing and other objects of the present invention are achieved with a spherical type of capacitor energy analyzer for charged particles, such as electrons, comprising three spherically configured members. An electrically conductive outer member is configured as a hollow spherical section having a first inlet edge. An electrically conductive first inner member is configured as a spherical portion disposed concentrically within the outer member with a defined space therebetween. The first inner member has a second inlet edge cooperative with the first inlet edge to form an inlet opening receptive of charged particles such that the charged particles follow curved trajectories in the defined space in the presence of a positive potential on the first inner member relative to the outer member. The first inner member further has a first outlet edge. An electrically conductive second inner member is configured as a spherical segment disposed concentrically within the outer member offset from the first inner member. The second inner member has a second outlet edge cooperative with the first outlet edge to define an exit slot for egress of charged particles having selected trajectories in the defined space.

According to a preferred embodiment, the outer member, the first inner member and the second inner member are cylindrically symmetrical about a common axis whereby the inlet opening and the exit slot are each cylindrically symmetrical about the common axis. In this embodiment the spherical section for the outer member exceeds hemispherical such that the inlet opening is receptive of charged particles emanating in a conical pattern from an effective location proximate the common axis. A conical lens includes means for focusing the charged particles in the conical pattern and, desirably, means for retarding electron energy by a selected amount.

The first and second inner members cooperatively define a generally spherical region therein, and the energy analyzer further comprises detector means situated in the generally spherical region for detecting the egressed charged particles. The detector means preferably has a cylindrical configuration with an axis coincidental with the common axis.

In a further embodiment the inlet opening and the exit slot are cooperatively disposed so that the angle subtended by the selected trajectories between the inlet opening and the exit slot is between about 0.8 $\pi$ and $\pi$ radians, preferably about 0.9 $\pi$ radians.

DETAILED DESCRIPTION OF THE INVENTION

Figure 1:
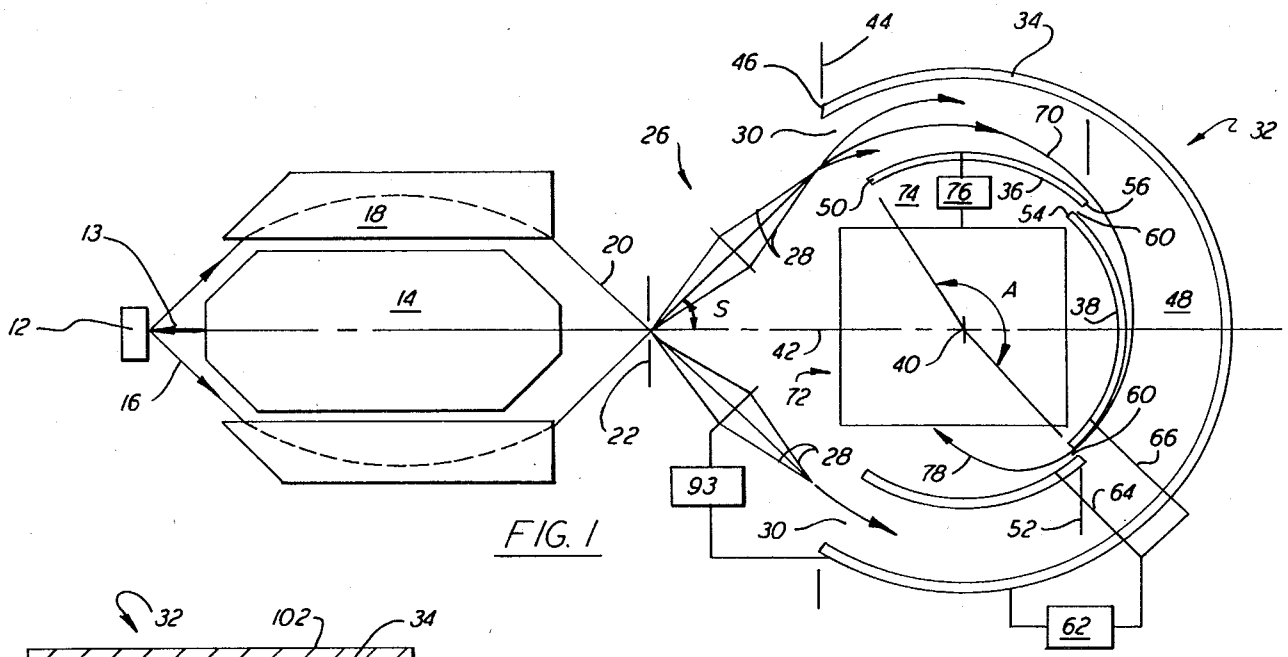
FIG. 1 is a schematic drawing of an energy analyzer according to the present invention.

A spherical capacitor energy analyzer for charged particles according to the present invention is illustrated schematically in FIG. 1. The system components are in appropriate enclosures (not shown) so as to operate at high vacuum. Charged particles, i.e. electrons or ions, are emitted from a sample specimen 12 or other source such as a radioactive source. In the preferred embodiment electrons are caused to be emitted from the surface of the sample specimen 12 in the conventional manner by means of a beam 13 generated by an energy gun 14 and directed at the specimen. For example, the gun may be a scanning electron beam source to cause Auger electrons to be emitted from a small moving area on the surface according to the scanning beam. Alternatively, with incident x-rays, photoelectron emission will occur and be utilized for electron spectroscopy for chemical analysis (ESCA).

Those electrons traveling in a selected conical path 16 are refracted by a conventional cylindrical mirror analyzer 18, which also serves the purpose of preliminary filtering of the electrons, to a converging beam 20 having a relatively narrow energy range. The energy gun shown in FIG. 1 is located conveniently co-axially within mirror analyzer 18, but alternatively may be off axis as required.

The converging beam then passes through a crossover aperture 22 in an image plane where it becomes conically divergent as rays 28. The diverging rays enter a conical lens means 26 which refocuses rays 28 of the beam into a ring shaped inlet opening 30 of an analyzer stage 32 and, also, retards the electrons by a selected change in energy. The solid half-angle S of the conical lens, which should equal the angle of a tangent to each of the outer and inner spherical members at opening 30, is generally between 0.6 and 0.8 radians; e.g., 0.73 radians.

The analyzer stage is formed of three truncated spherical members 34,36,38 which, according to the preferred embodiment, are mutually concentric with a common center 40 and are cylindrically symmetrical in a figure of rotation about a common axis 42. The common axis is also coincident with the common axis of conical lens 26 and cylindrical mirror analyzer 18. The first spherical member 34 is an electrically conductive outer member configured as a hollow spherical section truncated by a plane 44 perpendicular to common axis 42, forming a first inlet edge 46 partially defining inlet opening 30.

An electrically conductive first inner member 36 is configured as a-spherical portion disposed concentrically within the outer member creating a defined space 48 therebetween. The first inner member is similarly truncated forming a second inlet edge 50 cooperative with first inlet edge 46 to define the annular inlet opening 30. Thus, charged particles from conical lens 26 enter defined space 48 through inlet opening 30.

According to the present invention, first inner member 36 is further truncated by a plane 52 perpendicular to common axis 42 at a second location approximately symmetrical (through common center 40) to inlet edge 50 to form a first outlet edge 56. The precise location of the outlet edge is described in detail below.

An electrically conductive second inner member 38 is configured as a spherical segment disposed concentrically within outer member 34, further defining space 48. The second inner member has a slightly smaller radius than first inner member 36, and is offset from the first inner member. The second inner member is truncated proximate first outlet edge 56, forming the spherical segment with a second outlet edge 54 cooperative with the first outlet edge to define an annular exit slot 60.

A positive voltage potential from a power supply 62 is applied jointly through leads 64,66 to the first and second inner members 36,38, and relative to outer member 34. Thus, electrons within a small range of energies entering inlet opening 30 will travel in curved trajectories 68 in defined space 48 in a general manner conventional to spherical analyzers. Certain of these electrons in specific trajectories 70 (one shown) within a very narrow range of energy will egress the defined space through exit slot 60.

Detector means 72 is located in a spherical region 74 within the first and second inner members 36,38. Detector 72 has a positive voltage applied thereto from supply 76 relative to the inner members so as to attract the electrons in a path 78 for detection.

The trajectories of particles being analyzed have a nominal angle A of $\pi$ radians, measured at the center 40 of the spheres from inlet opening 30 to the opposite side of exit slot 60 in the same plane through the center. For small areas imaged on the sample, the electrons deviate little from this plane; but for large area ESCA applications, the electrons can deviate a large distance from this plane, thereby giving large input luminosity. This angular trajectory of $\pi$ is standard for a spherical analyzer. However, in a preferred embodiment of the present invention, it has been determined that the angle A should be somewhat smaller, for example 0.9 $\pi$ but preferably at least 0.8 $\pi$. The reason, associated with the fact that electrons egress at a radius inward from the inlet opening, is that an optimum combination of luminosity (a measure of electron collection efficiency) and energy resolution is obtained with such an angle.

Figure 2:
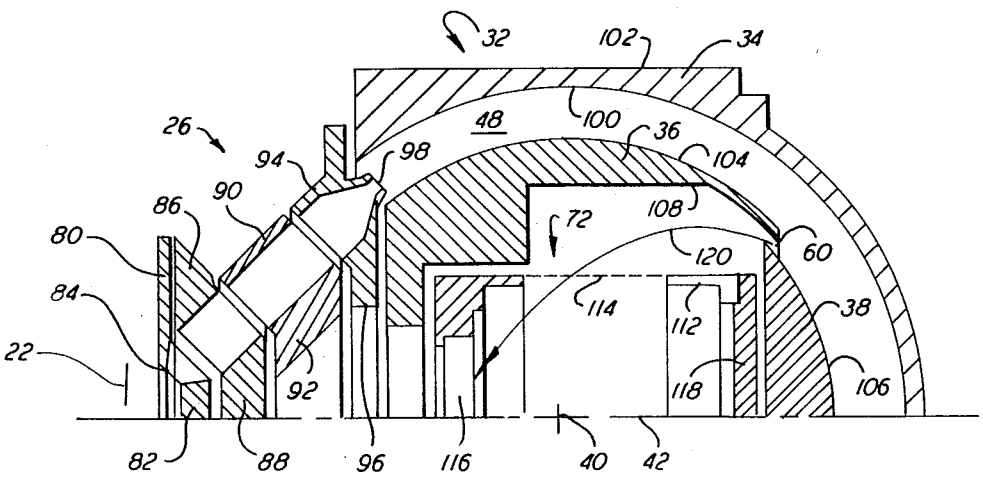
FIG. 2 is half of a longitudinal sectional view detailing certain components shown in FIG. 1.

FIG. 2 shows examples of details of conical lens means 26, spherical analyzer 32 and detector means 72. Conical lens 26 is formed of several cylindrically symmetric components. A first outer component 80 cooperating with a first inner component 82 forms an annular entrance aperture 84 for the diverging electrons passing from aperture 22. In tandem, second inner and outer components 86,88 and third inner and outer components 90,92 have appropriate voltages applied thereto by means of a voltage controller (at 93 schematically in FIG. 1) to refract the electrons back toward a central cone surface and to retard electron energy by a selected amount. Fourth inner and outer components 94,96 form an annular exit aperture 98 proximate inlet opening 30 of the spherical analyzer 32.

For example, to analyze electrons of 1000 eV energy with a retarding ratio of 10, components 86,88 have voltages from −700 to −1000 v and components 94,96 have a voltage of −900 v. For large area applications, components 90,92 are typically at or near zero volts; whereas, for small area applications, components 90,92 are typically at or near zero volts; whereas, for small area applications, components 90,92 are typically at −900 v. For this retarding ratio of 10 and analyzing 1000 eV electrons, the entire spherical analyzer assembly is floated at −900 v.

The inner surface 100 of outer member 34 is spherical, but the outer surface 102 may be configured as desired for mounting purposes; for example, cylindrically as indicated in the figure. The inner members 36,38 have respective outer surfaces 104,106 that are spherical but their inner surfaces 108,110 are such as to accommodate and cooperate with detector means 72.

The detector means includes a cylindrical support member 112 for a cylindrical screen grid 114 and is mounted coaxially within spherical analyzer 32. At the base of the support member 112 (toward conical lens 26) is retained a conventional channel plate electron multiplier 116 or other desired detector component. An end plate 118 is attached to the other end of support member 112. First inner spherical member 36 has an inward-facing cylindrical surface 108 spaced outwardly from support member 112 and its grid 114. As shown by a trajectory 120, particles from slot 60 are deflected from surface 108 by its negative voltage with respect to the support member and pass through grid 114 and to channel plate multiplier 116. Signals from the channel plate multiplier are conventionally detected with a system (not shown) for presentation as data or as an image on a monitor or a camera showing a spectrum versus energy, Auger maps, or the like.

Because of the requirements for leadthroughs and supports (not shown) for the inner components, the entire defined annular space is not available for analyzing all electrons entering the inlet opening. However, the efficiency of collection for the overall system (including lenses) is expected to be at least 50% with a 0.3% resolution and a point source. Typical dimensions are 7.6 cm for the median radius of defined space 48, and 1.8 cm for the width of the defined space between the outer member and the first inner member. A suitable exit slot width, corresponding to the lesser radius of second inner sphere 38, is 3 mm.

The luminosity of this instrument is equivalent to a standard SCA of about twice the radius. Thus for large area applications, the signal matches that of a standard SCA of larger size. For small area ESCA and Auger applications, the point transmission or input solid angle is important. The analyzer of the present invention has about ten times the input solid angle as the standard SCA with cylindrical input lens. Compared with a conventional SCA with a multichannel detector, the present instrument will still give about two times greater signal, in a smaller configuration with no multi-channel detector required.

Within the concept of the present invention the relative positions of the inner and outer spherical members may be reversed. Thus the spherical portion and the spherical segment cooperatively forming the exit slot may be spaced radially outward from the hollow spherical section. In such a case, the charged particles will egress from the exit slot divergently from the outside of the analyzer. An appropriate annular detection system may be utilized, or a lens system may be arranged to bring the particles back to the axis for detection.

Thus, the advantages of a hemispherical type of analyzer, including high resolution of energy, are retained. Additionally, reception of electrons in the spherically symmetric configuration greatly increases the collection efficiency and, therefore, a substantially better signal is obtained. The first and second inner spherical members cooperate with the outer spherical member to maintain a uniform field in the defined space, ensuring precision selection of energy. Selective retardation of electron energy by the conical lens allows selective energy detection and spectral analysis of the electrons emitted from the sample surface. Thus the analyzer described herein is particularly useful for ESCA and for Auger electron energy analysis. Another key advantage is the ability to retain the coaxial electron gun in analyzer configuration for scanning Auger applications.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A spherical capacitor energy analyzer for charged particles, comprising:

an electrically conductive first member configured as a hollow spherical section having a first inlet edge;

an electrically conductive second member configured as a spherical portion spaced concentrically from the first member with a defined space therebetween, the second member having a second inlet edge cooperative with the first inlet edge to form an inlet opening receptive of charged particles such that the charged particles follow curved trajectories in the defined space in the presence of a first voltage applied to the second member relative to the first member, the second member further having a first outlet edge;

an electrically conductive third member configured as a spherical segment spaced concentrically from the first member offset from the second member and having a second outlet edge cooperative with the first outlet edge to define an exit slot for egress of charged particles having selected trajectories in the defined space in the presence of a second voltage applied to the third member relative to the first member; and detector means for detecting the egressed charged particles.

2. A spherical capacitor energy analyzer for charged particles, comprising:

an electrically conductive outer member configured as a hollow spherical section having a first inlet edge;

an electrically conductive first inner member configured as a spherical portion disposed concentrically within the outer member with a defined space therebetween, the first inner member having a second inlet edge cooperative with the first inlet edge to form an inlet opening receptive of charged particles such that the charged particles follow curved trajectories in the defined space in the presence of a first voltage applied to the first inner member relative to the outer member, the first inner member further having a first outlet edge;

an electrically conductive second inner member configured as a spherical segment disposed concentrically within the outlet member offset from the first inner member and having a second outlet edge cooperative with the first outlet edge to define an exit slot for egress of charged particles having selected trajectories in the defined space, in the presence of a second voltage applied to the third member relative to the first member; and detector means for detecting the egressed charged particles.

3. An energy analyzer according to claim 2 wherein the outer member, the first inner member and the second inner member are cylindrically symmetrical about a common axis whereby the inlet opening and the exit slot are each cylindrically symmetrical about the common axis, and the spherical section for the outer member exceeds hemispherical such that the inlet opening is receptive of charged particles emanating in a conical pattern from an effective location proximate the common axis.

4. An energy analyzer according to claim 3 further comprising conical lens means for focusing the charged particles in the conical pattern.

5. An energy analyzer according to claim 4 wherein the conical lens means includes means for retarding charged particle energy by a selected amount.

6. An energy analyzer according to claim 3 wherein the first and second inner members cooperatively define a generally spherical region therein, and the energy analyzer further comprises detector means situated in the generally spherical region for detecting the egressed charged particles.

7. An energy analyzer according to claim 6 wherein the detector means has a cylindrical configuration with an axis coincidental with the common axis.

8. An energy analyzer according to claim 3 wherein the inlet opening and the exit slot are cooperatively disposed so that the angle subtended by the selected trajectories between the inlet opening and the exit slot is between about 0.8 $\pi$ and $\pi$ radians.

9. An energy analyzer according to claim 8 wherein the angle subtended is about 0.9 $\pi$ radians.

10. An energy analyzer according to claim 2 further comprising an electron beam source directed at a sample specimen to cause emission of Auger electrons constituting the charged particles.

11. An energy analyzer according to claim 2 further comprising an x-ray source directed at a sample specimen to cause emission of photoelectrons constituting the charged particles.

* * * * *